US006488578B1

(12) United States Patent
Kuo

(10) Patent No.: US 6,488,578 B1
(45) Date of Patent: Dec. 3, 2002

(54) FACEPLATE OF A BLOWER FOR AN AIR CONDITIONER

(76) Inventor: Chin-Sheng Kuo, No. 45, Lane 738, Chung-Cheng Road, Kuan-Miao Hsiang, Tainan Hsien (TW)

( * ) Notice: Subject to any disclaimer, the term of this patent is extended or adjusted under 35 U.S.C. 154(b) by 0 days.

(21) Appl. No.: 10/029,920

(22) Filed: Dec. 31, 2001

(51) Int. Cl.[7] ..... F24F 7/00
(52) U.S. Cl. ..... 454/248; 454/245
(58) Field of Search ..... 454/248, 245, 454/241; 62/407, 408, 426

(56) References Cited

U.S. PATENT DOCUMENTS 2,185,919 A * 1/1940 Kurth ..... 454/248
3,885,462 A * 5/1975 Krook ..... 362/218
5,251,461 A * 10/1993 Fallows et al. ..... 454/201

* cited by examiner

*Primary Examiner*—Derek Boles

(57) ABSTRACT

A faceplate of a blower for an air conditioner in the present invention relates to a faceplate juxtaposed with at least one wind outlet and at least one wind inlet, wherein each of the wind outlets and each of the wind inlets are respectively disposed with a wind-out windpipe base and a wind-in windpipe base for being connected with windpipes; each of the wind outlets is provided with a swing member for adjusting blowing direction; each of the wind inlets is provided with a detachable filter net and a detachable grille, by which a combination of said components described above provides said faceplate with functions of wind-blowing, wind-suction and blowing-direction adjustment to achieve an optimum effect in air circulation.

5 Claims, 13 Drawing Sheets

FACEPLATE OF A BLOWER FOR AN AIR CONDITIONER

BACKGROUND OF THE INVENTION

1. Field of the Invention

This invention relates to a faceplate of a blower for an air conditioner, particularly to one juxtaposed with at least one wind outlet and at least one wind inlet, wherein each of the wind outlets is pivoted with a swing member, by which a combination of the components described above provides the faceplate with functions of wind-blowing, wind-suction and blowing-direction adjustment.

2. Description of the Prior Art

A known conventional air conditioning system, as shown in FIG. 1, has many wind-out faceplates 11 and wind-in faceplates 12 respectively installed on the ceiling formed with steel frames 10 and uses windpipes to connect the wind-out faceplates 11 with a main machine to blow air out. Each of the wind-in faceplates 12 is installed around each of the wind-out faceplates 11 and adhesived with a filter net. This kind of design is very inconvenient in repairing or cleaning work because the whole wind-in faceplate 12 and the whole wind-out faceplate 11 are required to be disassembled for checking or repairing components in the interior of the known air conditioning system. Moreover, it is a very heavy work for repairmen to disassemble so many wind-in faceplates 12 and wind-out faceplates 11 in repairing or cleaning work, which is also very troublesome and time-consuming.

SUMMARY OF THE INVENTION

It is one primary object of the present invention to offer a faceplate of a blower for an air conditioner capable of blowing air out and sucking air in at the same time.

It is another object of the present invention to offer a faceplate of a blower for an air conditioner provided with a function of blowing-direction adjustment.

It is one further object of the present invention to offer a faceplate of a blower for an air conditioner provided with a filter net and a grille that are convenient for assembling and disassembling, and being rapid in repairing or cleaning work.

One primary feature of the invention is to provide a faceplate of a blower for an air conditioner juxtaposed with at least one wind outlet and at least one wind inlet, wherein each of the wind outlets is disposed with a wind-out windpipe base provided with at least one wind-out hole for being covered with a windpipe to blow air out.

One another feature of the invention is to provide a faceplate of a blower for an air conditioner juxtaposed with at least one wind outlet and at least one wind inlet, wherein each of the wind outlets is disposed with a wind-out windpipe base provided with at least one wind-out hole for being covered with a windpipe to blow air out; each of the wind inlets is disposed with a wind-in windpipe base provided with at least one wind-in hole for being engaged with a windpipe to suck air in.

One further feature of the invention is to provide a faceplate of a blower for an air conditioner juxtaposed with at least one wind outlet and at least one wind inlet, wherein the faceplate is combined with an integral windpipe base assembly provided with at least one wind-out hole and at least one wind-in hole for being connected with windpipes to blow air out and suck air in.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
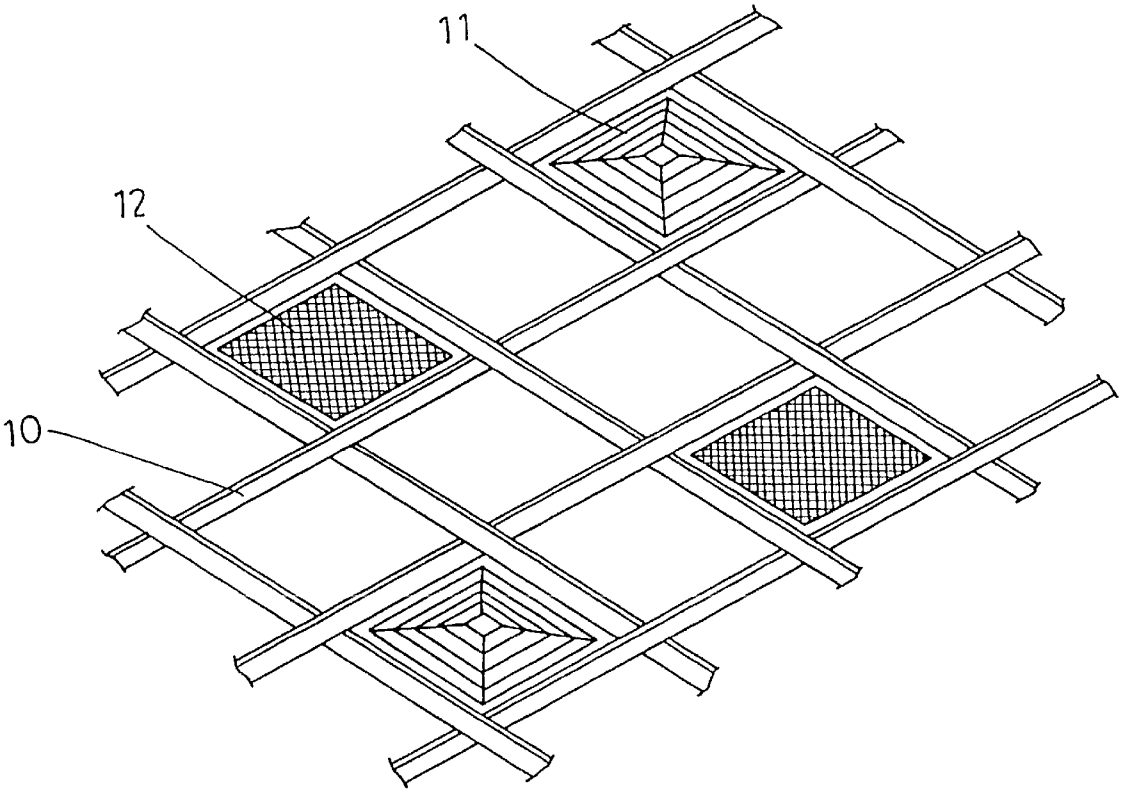
FIG. 1 (PRIOR ART)
FIG. 1 is a schematic view of a known conventional air conditioning system, showing an arrangement of wind-out faceplates and wind-in faceplates installed on a ceiling formed with steel frames.
Figure 2:
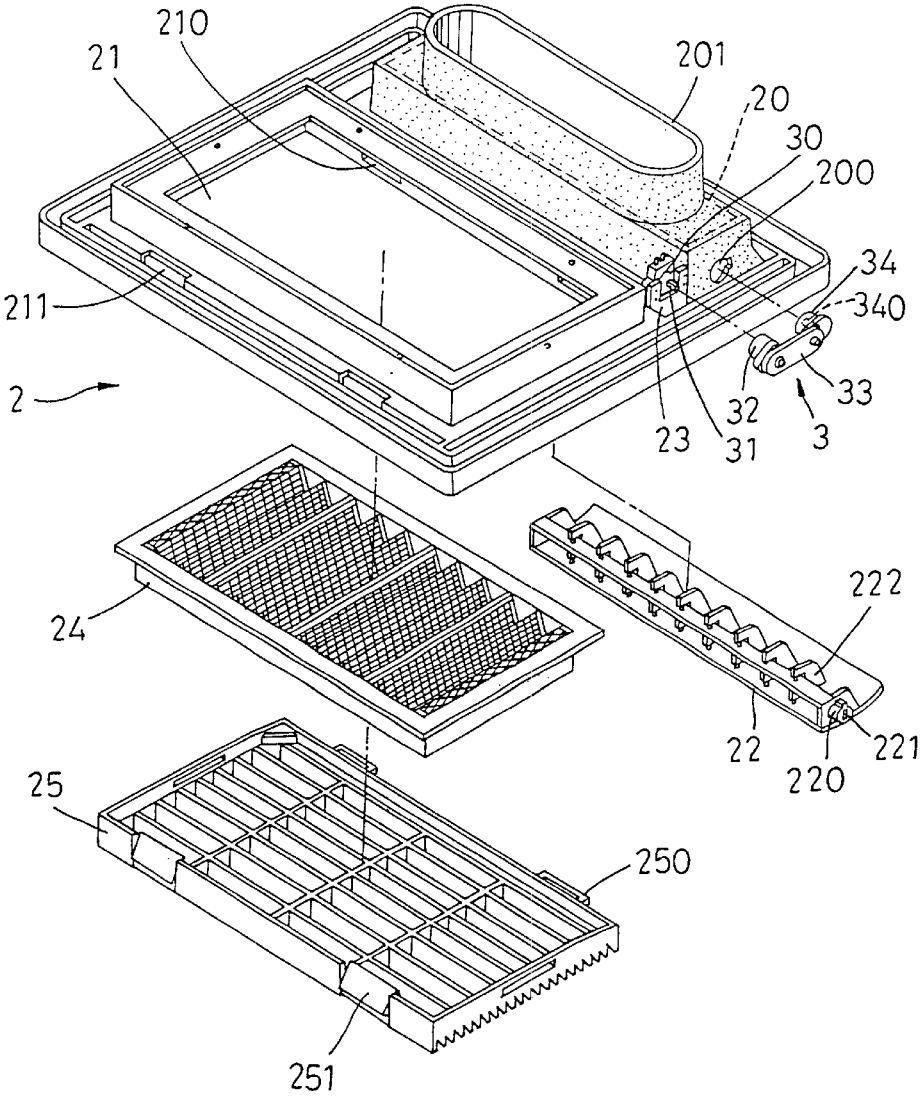
FIG. 2 is an exploded perspective view of a faceplate of a blower for an air conditioner in the present invention, showing the construction of a first preferred embodiment.
Figure 3:
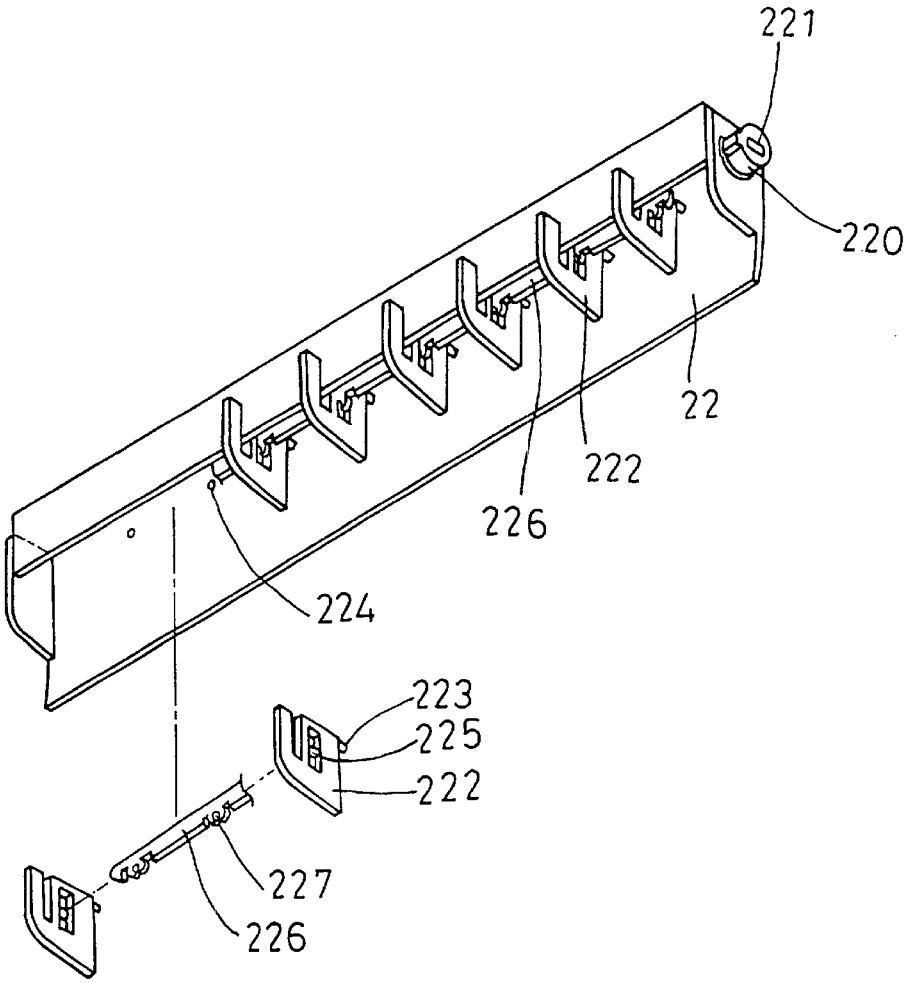
FIG. 3 is an exploded perspective view of the faceplate of a blower for an air conditioner in the present invention, showing the construction of a swing member.
Figure 4:
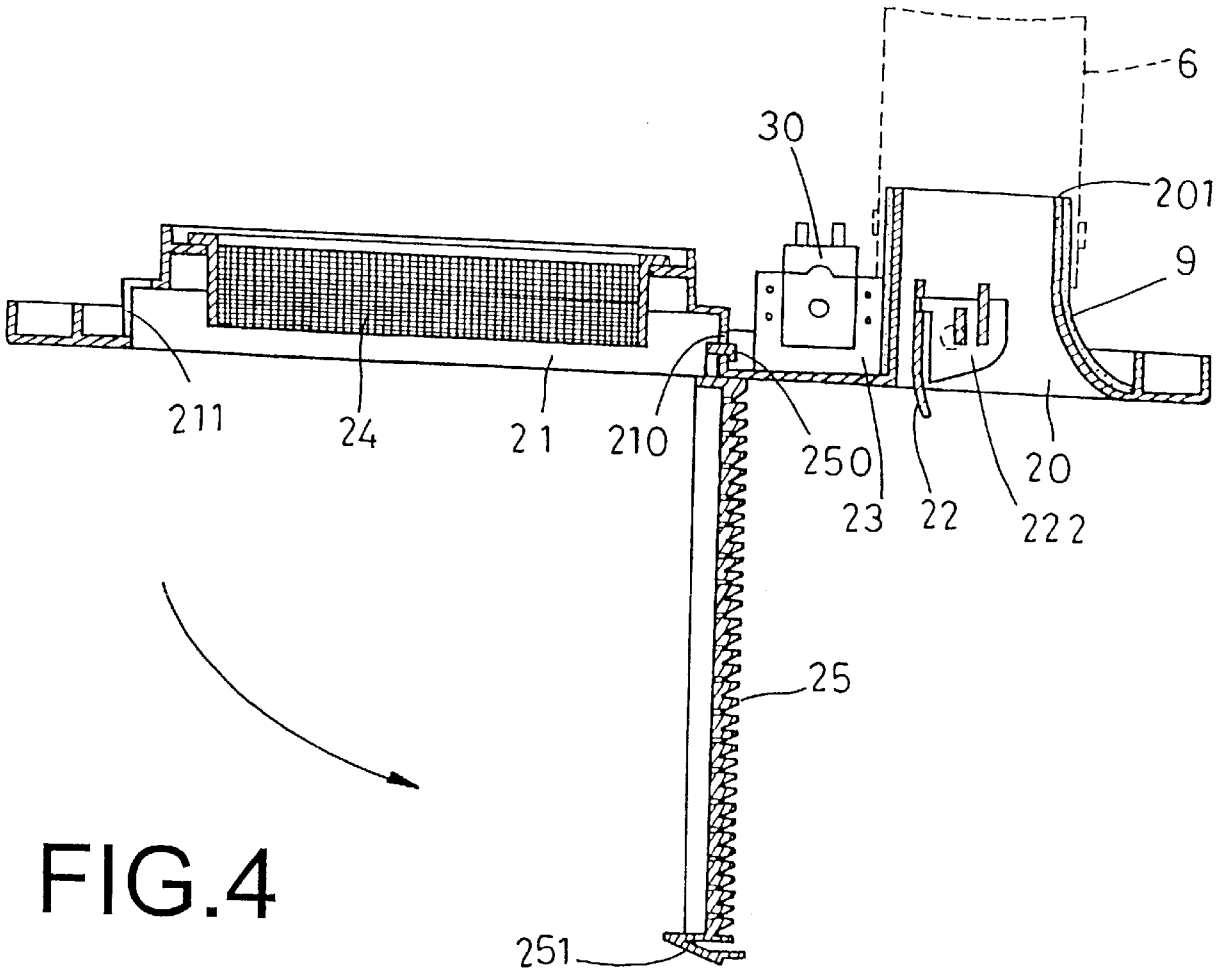
FIG. 4 is a side cross-sectional view of the faceplate of a blower for an air conditioner in the present invention, showing the first preferred embodiment in operation.

A first preferred embodiment of a faceplate of a blower for an air conditioner in the present invention, as shown in FIGS. 2 to 4, includes a faceplate 2 and a driving device 3 as main components.

The faceplate 2 is juxtaposed with at least one wind outlet 20 and at least one wind inlet 21. A wind-out windpipe base 201 is disposed on each of the wind outlets 20 for being covered with a windpipe 6 to blow air out, as shown in FIG. 4. Two through holes 200 are respectively disposed in both sidewalls of each of the wind outlets 20 for being pivoted and combined with a swing member 22. The swing member 22 driven by the driving device 3 has two pivot journals 220 outwardly protruded at both sidewalls of the swing member 22 for corresponding to the two through holes 200 of the wind outlet 20 and a plurality of insert grooves 224 disposed in a plate body of the swing member 22. One of the two pivot journals 220 is provided with an insert hole 221 for being combined with the driving device 3. As shown in FIG. 3, a plurality of leaves 222 whose turning direction is adjustable are arranged on the plate body of the swing member 22. Each of the leaves 222 has an insert rod 223 protruded at one side for being inserted into and pivoted with each of the insert grooves 224 and a stub rod 225 disposed therein. A connecting rod 226 connected with the leaves 222 is provided with retaining rings 227 for being correspondingly engaged with the stub rods 225 of the leaves 222, by which the leaves 222 are capable of being conveniently turned to different directions so as to adjust the wind-blowing direction of the wind outlet 20. Inside the faceplate 2, a motor seat 23 disposed proximate one side of the wind outlet 20 is capable of being mounted with a motor 30 of the driving device 3, by which the swing member 22 can automatically swing back and forth with oscillating movements under the driving of the driving device 3 to adjust the wind-blowing angle of the leaves 222 to increase blowing stroke. Therefore, the blowing area is capable of being expanded by the turning of the leaves 222 to adjust blowing direction of the wind outlet 20 and by the oscillating movements of the swing member 22 to adjust wind-blowing angle.

Moreover, a conveniently changeable filter net 24 and a detachable grille 25 are disposed in the wind inlet 21, as shown in FIGS. 2 and 4. At least one hook member 250 disposed in one sidewall of the grille 25 is capable of being correspondingly hooked onto at least one groove 210 disposed in an inner wall of one side of one of the wind inlets 21; at least one elastic-retaining member 251 disposed in the other sidewall of the grille 25 is capable of being correspondingly engaged into at least one engagement hole 211 disposed in the other side of the wind inlet 21.

The driving device 3 connected with the swing member 22 has a motor 30 capable of being screwed to the motor seat 23 in position and whose axle 31 is outwardly protruded for being pivoted with a driving member 32. An outer end of the driving member 32 is combined with one end of a transmission rod 33 whose the other end is combined with one side of an oscillating follower 34. The other side of the oscillating follower 34 is protruded with a projecting rod 34 for being inserted into and combined with the insert hole 221 of the swing member 22, by which the driving device 3 is constructed to drive the swing member 22 to automatically swing back and forth with oscillating movements.

In assembling and using, referring to FIGS. 2 to 4, firstly combine the filter net 24 and the grille 25 onto the wind inlet 21. The grille 25 is hooked onto the wind inlet 21 and is capable of being held to the faceplate 2 in a suspended way of allowing one side of the grille 25 to be removed from the faceplate 2, as shown in FIG. 4. Secondly, extend the two pivot journals 220 that are outwardly protruded at both sidewalls of the swing member 22 of the faceplate 2 respectively through the two through holes 200 that are disposed in both sidewalls of the wind outlet 20 to make the 20 insert hole 221 of one of the two pivot journals 220 aligned with and inserted by the projecting rod 340 of the oscillating rod 34 of the driving device 3. Thirdly, orderly connect the transmission rod 33 and the driving member 32 from the outer surface of the oscillating rod 34 to the axle 31 of the motor, by which the driving device 3 is constructed to drive the swing member 22 that is pivoted inside the wind outlet 20 to automatically swing back and forth with oscillating movements. Finally, cover a windpipe 6 on the wind-out windpipe base 201 of the wind-out hole 20 in position. With a combination of the components described above provides the faceplate of a blower for an air conditioner in the present invention with functions of wind-blowing as well as wind-suction, and with convenience for repairmen to check and repair components in the interior of the faceplate 2.

Figure 5:
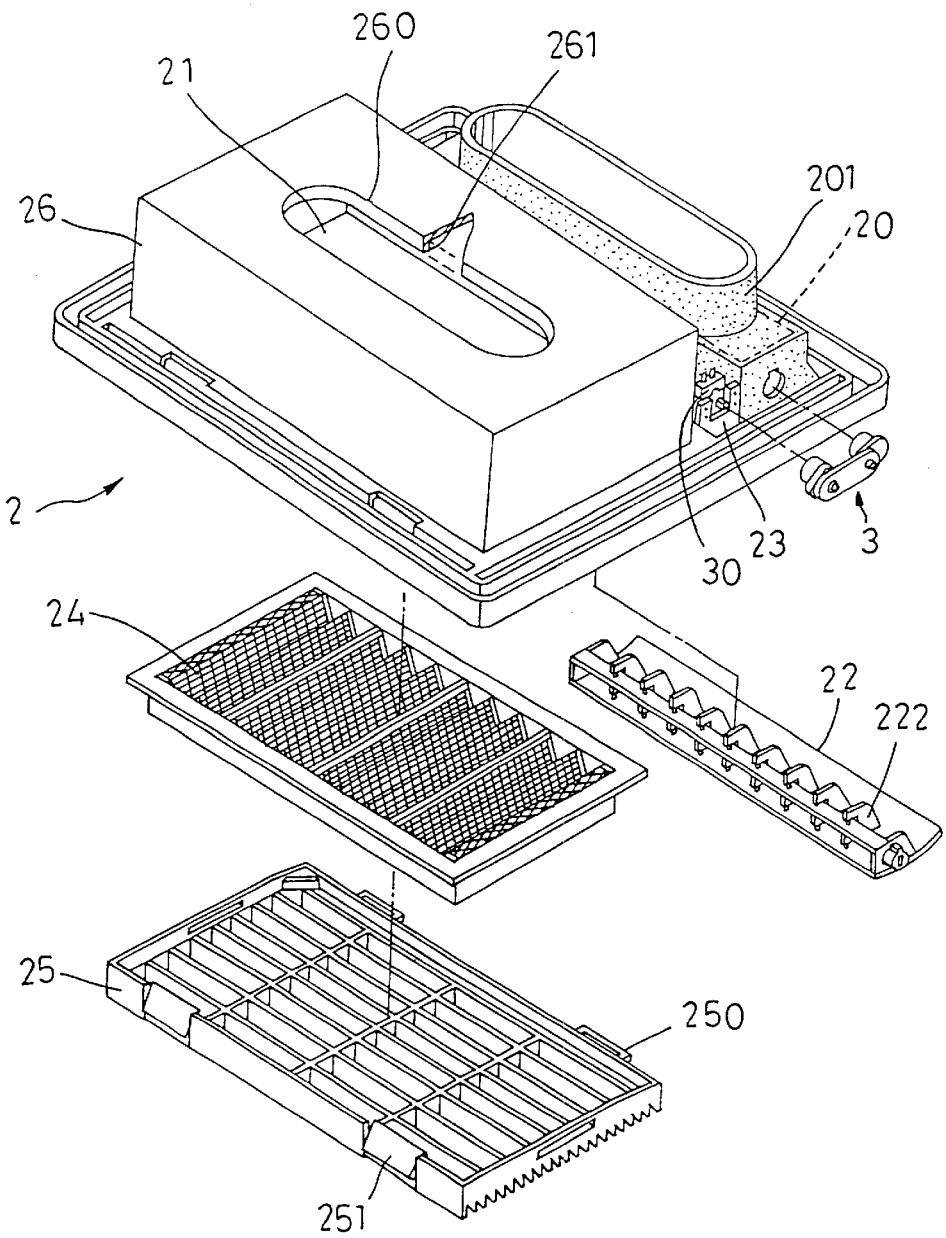
FIG. 5 is an exploded perspective view of the faceplate of a blower for an air conditioner in the present invention, showing the construction of a second preferred embodiment.
Figure 6:
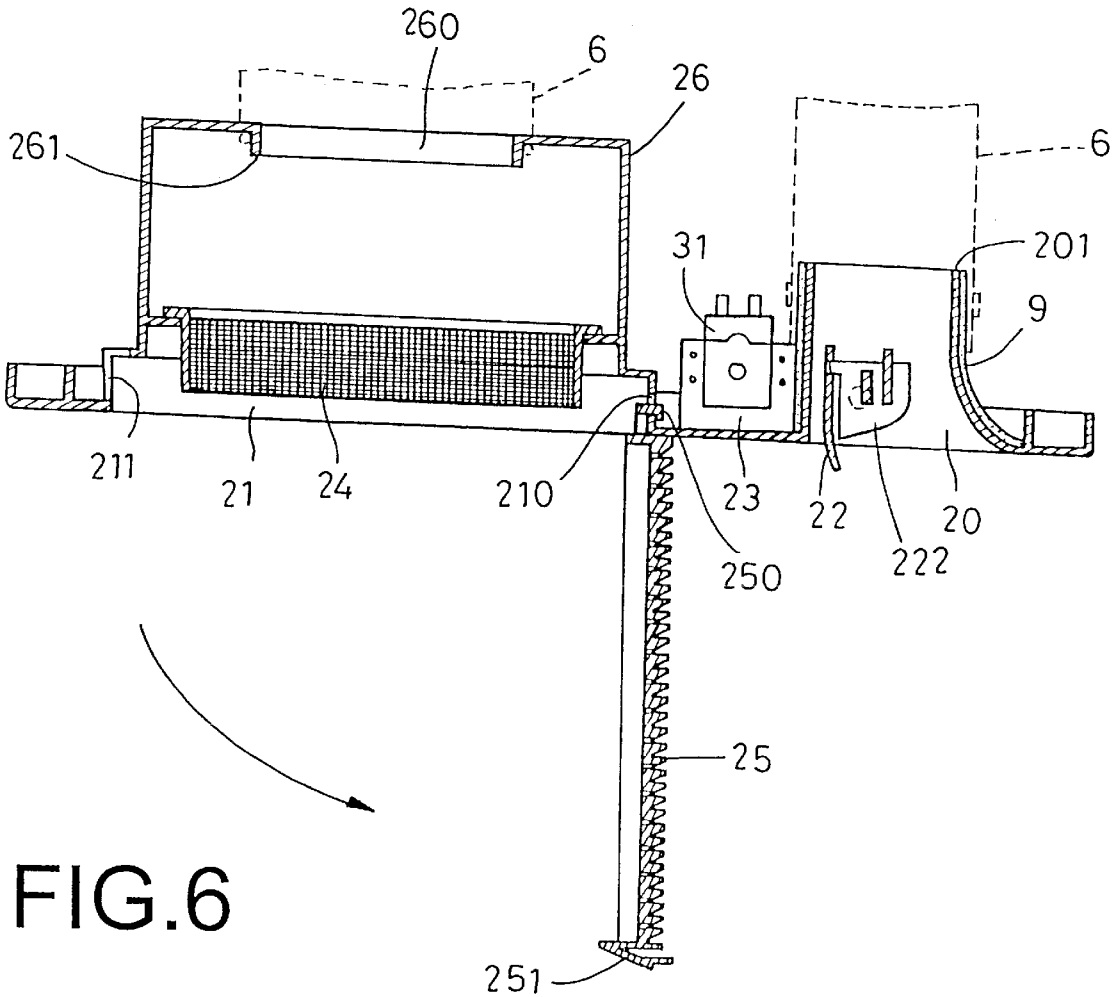
FIG. 6 is a side cross-sectional view of the faceplate of a blower for an air conditioner in the present invention, showing the second preferred embodiment in operation.

A second preferred embodiment of the faceplate of a blower for an air conditioner in the present invention, as shown in FIGS. 5 and 6, includes a faceplate 2 and a driving device 3 as main components.

Like the first preferred embodiment, the faceplate 2 is juxtaposed with at least one wind outlet 20 and at least one wind inlet 21. A wind-out windpipe base 201 disposed on each of the wind outlets 20 is covered with a windpipe 6. A swing member 22 is pivoted in the wind outlet 20 and is driven by the driving device 3. A plurality of leaves 222 whose turning direction is adjustable are arranged on a plate body of the swing member 22 and are conveniently turned to different directions so as to adjust the blowing direction of the wind outlet 20. Inside the faceplate 2, a motor seat 23 disposed proximate one side of the wind outlet 20 is capable of being mounted with a motor 30 of the driving device 3. A conveniently changeable filter net 24 and a detachable grille 25 are disposed in the wind inlet 21, as shown in FIG. 6. At least one hook member 250 disposed in one sidewall of the grille 25 is capable of being correspondingly hooked onto at least one groove 210 disposed in an inner wall of one side of one of the wind inlets 21; at least one elastic-retaining member 251 disposed in the other sidewall of the grille 25 is capable of being correspondingly engaged into at least one engagement hole 211 disposed in the other side of the wind inlet 21.

Furthermore, a wind-in windpipe base 26 integrated with each of the wind inlets 21 of the faceplate 2 is provided with at least one wind-in hole 260 whose circumference is disposed with an engagement edge 261 for convenience of being engaged with a windpipe 6 to suck air in.

Figure 7:
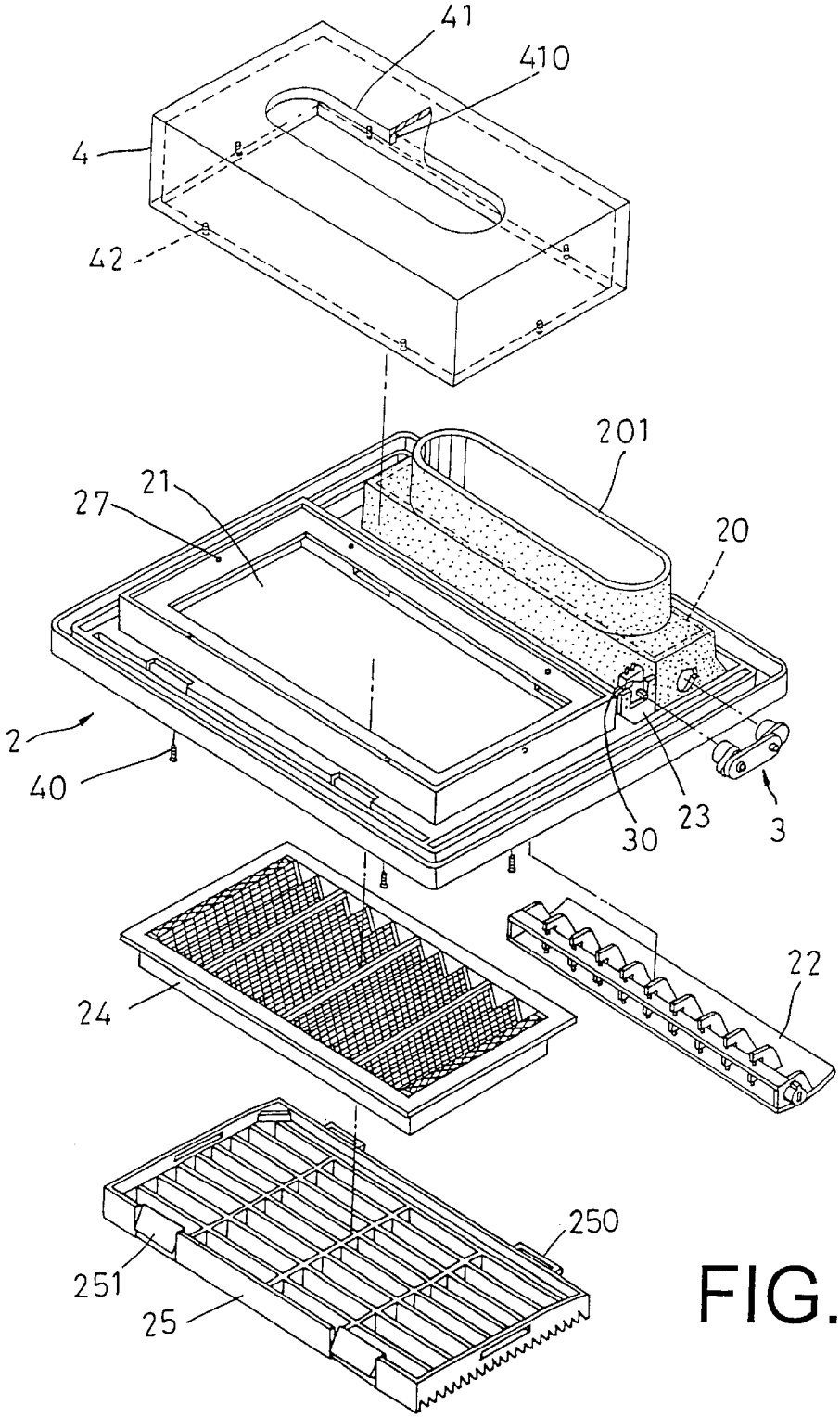
FIG. 7 is an exploded perspective view of the faceplate of a blower for an air conditioner in the present invention, showing the construction of a third preferred embodiment.

A third preferred embodiment of the faceplate of a blower for an air conditioner in the present invention, as shown in FIG. 7, includes a faceplate 2 and a driving device 3 as main components.

Like the first preferred embodiment, the faceplate 2 is juxtaposed with at least one wind outlet 20 and at least one wind inlet 21. A swing member 22 is pivoted in the wind outlet 20 and is driven by the driving device 3. A wind-out windpipe base 201 is disposed on each of the wind outlets 20 for being covered with a windpipe 6 to blow air out. A conveniently changeable filter net 24 and a detachable grille 25 are disposed in the wind inlet 21.

Furthermore, a detachable box-like wind-in windpipe base 4 is capable of being combined with each of the wind inlets 21 of the faceplate 2 by correspondingly aligning a plurality of screw holes 42 of the wind-in windpipe base 4 to a plurality of combining holes 27 of the wind inlet 21 and using combining members 40 to screw the combining holes 27 and the screw holes 42 together in position from a bottom of the wind inlet 21. The wind-in windpipe base 4 has at least one wind-in hole 41 whose circumference is disposed with an engagement edge 410 for convenience of being engaged with a windpipe 6 to suck air in.

Figure 8:
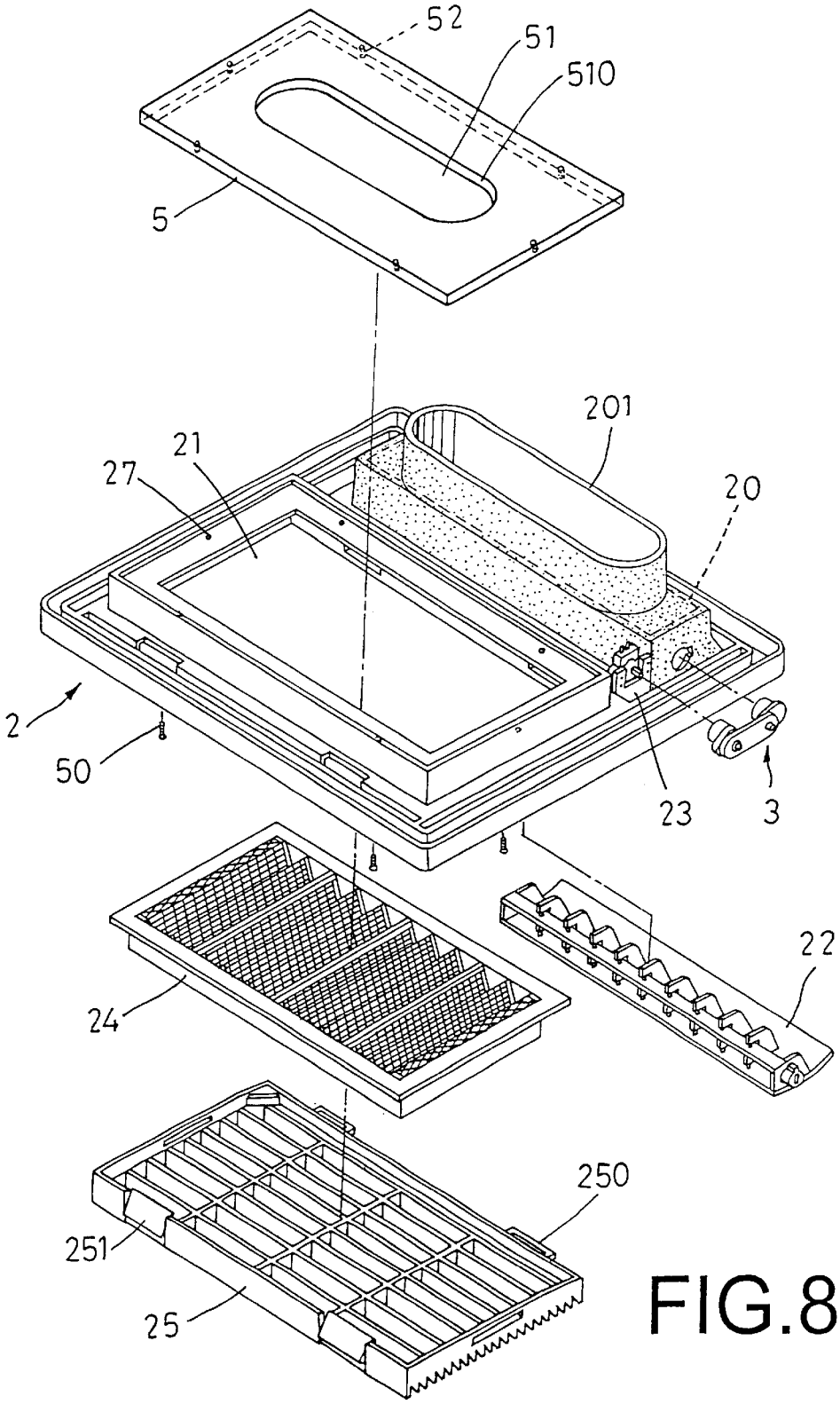
FIG. 8 is an exploded perspective view of the faceplate of a blower for an air conditioner in the present invention, showing the construction of a fourth preferred embodiment.

A fourth preferred embodiment of the faceplate of a blower for an air conditioner in the present invention, as shown in FIG. 8, includes a faceplate 2 and a driving device 3 as main components.

Like the first preferred embodiment, the faceplate 2 is juxtaposed with at least one wind outlet 20 and at least one wind inlet 21. A swing member 22 is pivoted in the wind outlet 20 and is driven by the driving device 3. A wind-out windpipe base 201 is disposed on each of the wind outlets 20 for being covered with a windpipe 6 to blow air out. A conveniently changeable filter net 24 and a detachable grille 25 are disposed in the wind inlet 21.

Furthermore, a detachable plate-like wind-in windpipe base 5 is capable of being combined with each of the wind inlets 21 of the faceplate 2 by correspondingly aligning a plurality of screw holes 52 of the wind-in windpipe base 5 to a plurality of combining holes 27 of the wind inlet 21 and using combining members 50 to screw the combining holes 27 and the screw holes 52 together in position from a bottom of the wind inlet 21. The wind-in windpipe base 5 has at least one wind-in hole 51 whose circumference is disposed with an engagement edge 510 for convenience of being engaged with a windpipe 6 to suck air in.

Figure 9:
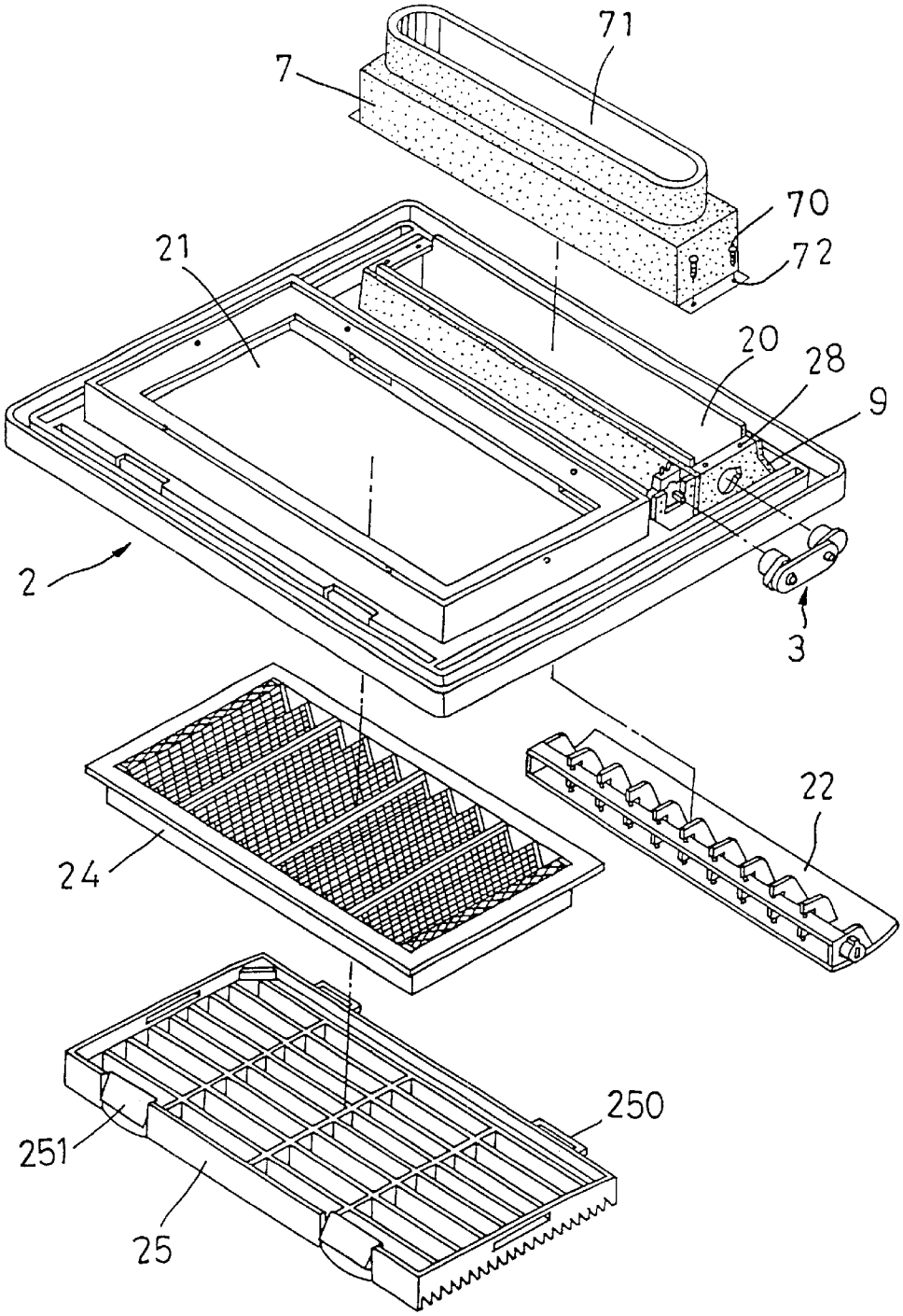
FIG. 9 is an exploded perspective view of the faceplate of a blower for an air conditioner in the present invention, showing the construction of a fifth preferred embodiment.

A fifth preferred embodiment of the faceplate of a blower for an air conditioner in the present invention, as shown in FIG. 9, includes a faceplate 2 and a driving device 3 as main components.

Like the first preferred embodiment, the faceplate 2 is juxtaposed with at least one wind outlet 20 and at least one wind inlet 21. A swing member 22 is pivoted in the wind outlet 20 and is driven by the driving device 3. A conveniently changeable filter net 24 and a detachable grille are disposed in the wind inlet 21.

Furthermore, a detachable wind-out windpipe base 7 is capable of being combined with each of the wind outlets 20 of the faceplate 2 by correspondingly aligning a plurality of through holes 72 of the wind-out windpipe base 7 to a plurality of combining holes 28 of the wind outlet 20 and using combining members 70 to screw the through holes 72 and the combining holes 28 together in position. The wind-out windpipe base 7 has at least one wind-out hole 71 for convenience of being covered with a windpipe 6 to blow air out.

Figure 10:
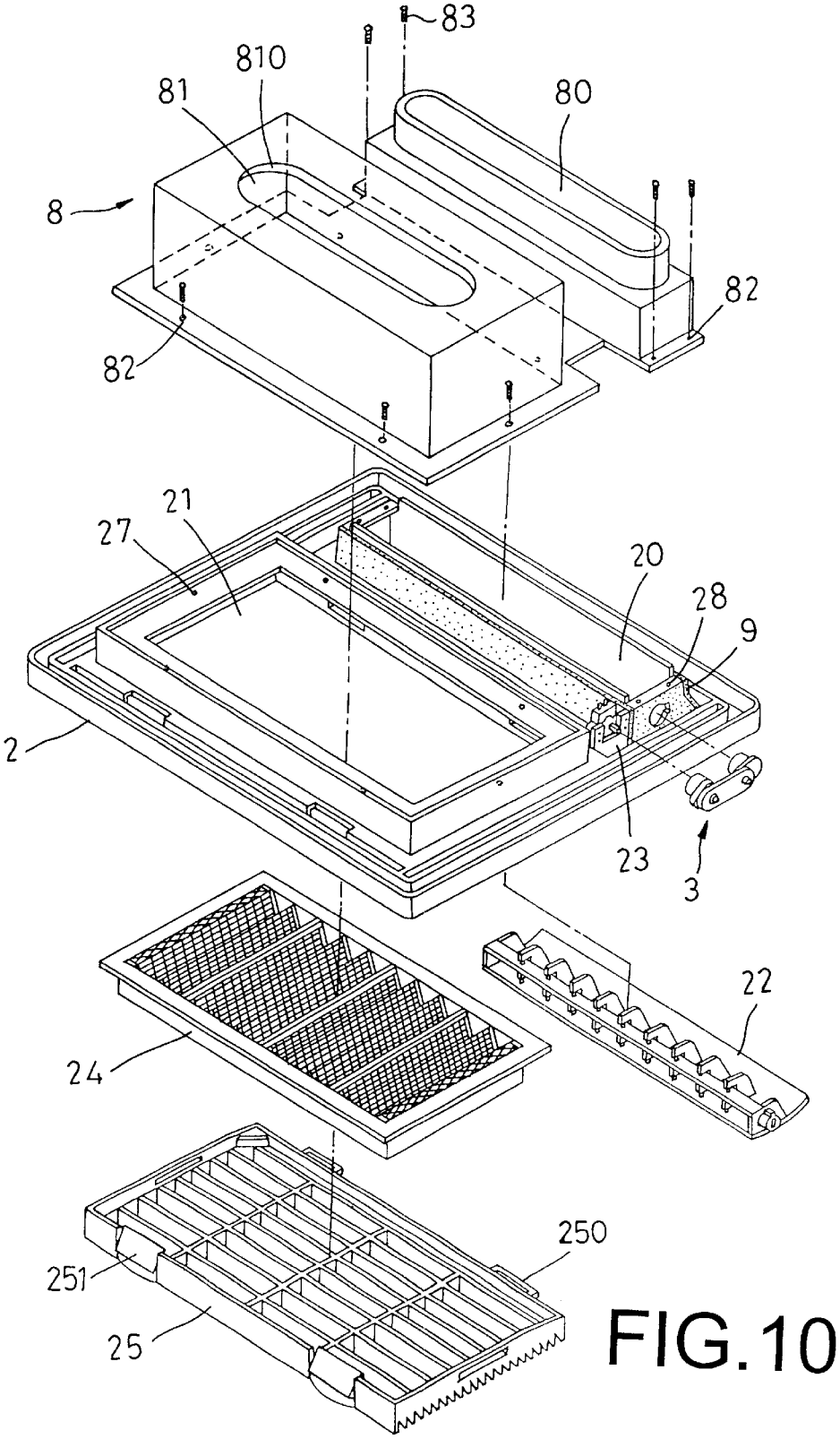
FIG. 10 is an exploded perspective view of the faceplate of a blower for an air conditioner in the present invention, showing the construction of a sixth preferred embodiment.

A sixth preferred embodiment of the faceplate of a blower for an air conditioner in the present invention, as shown in FIG. 10, includes a faceplate 2 and a driving device 3 as main components.

Like the first preferred embodiment, the faceplate 2 is juxtaposed with at least one wind outlet 20 and at least one wind inlet 21. A swing member 22 is pivoted in the wind outlet 20 and is driven by the driving device 3. A conveniently changeable filter net 24 and a detachable grille 25 are disposed in the wind inlet 21.

Furthermore, the faceplate 2 is capable of being combined with an integral windpipe base assembly 8 provided with at least one wind-out hole 80 and at least one wind-in hole 81 for corresponding to each of the wind outlets 20 and each of the wind inlets 21 of the faceplate 2. Each of the wind-out holes 80 is capable of being covered with a windpipe 6 to blow air out. Each of the wind-in holes 81 is provided with an engagement edge 810 for being engaged with a windpipe 6 to suck air out. The integral windpipe base assembly 8 is capable of being combined with the faceplate 2 by correspondingly aligning a plurality of through holes 82 disposed around the circumference of the integral windpipe base assembly 8 to a plurality of combining holes 27 and combining holes 28 of the faceplate 2 and using screw members 83 to screw the through holes 82, the combining holes 27 and the combining holes 28 together in position.

Besides, among the components described above, all wall surfaces of the wind outlets 20 of the faceplate 2 and extension portions of the wind outlets 20 for being connected with windpipes 6 are spread with temperature-insulting materials 9.

Figure 11:
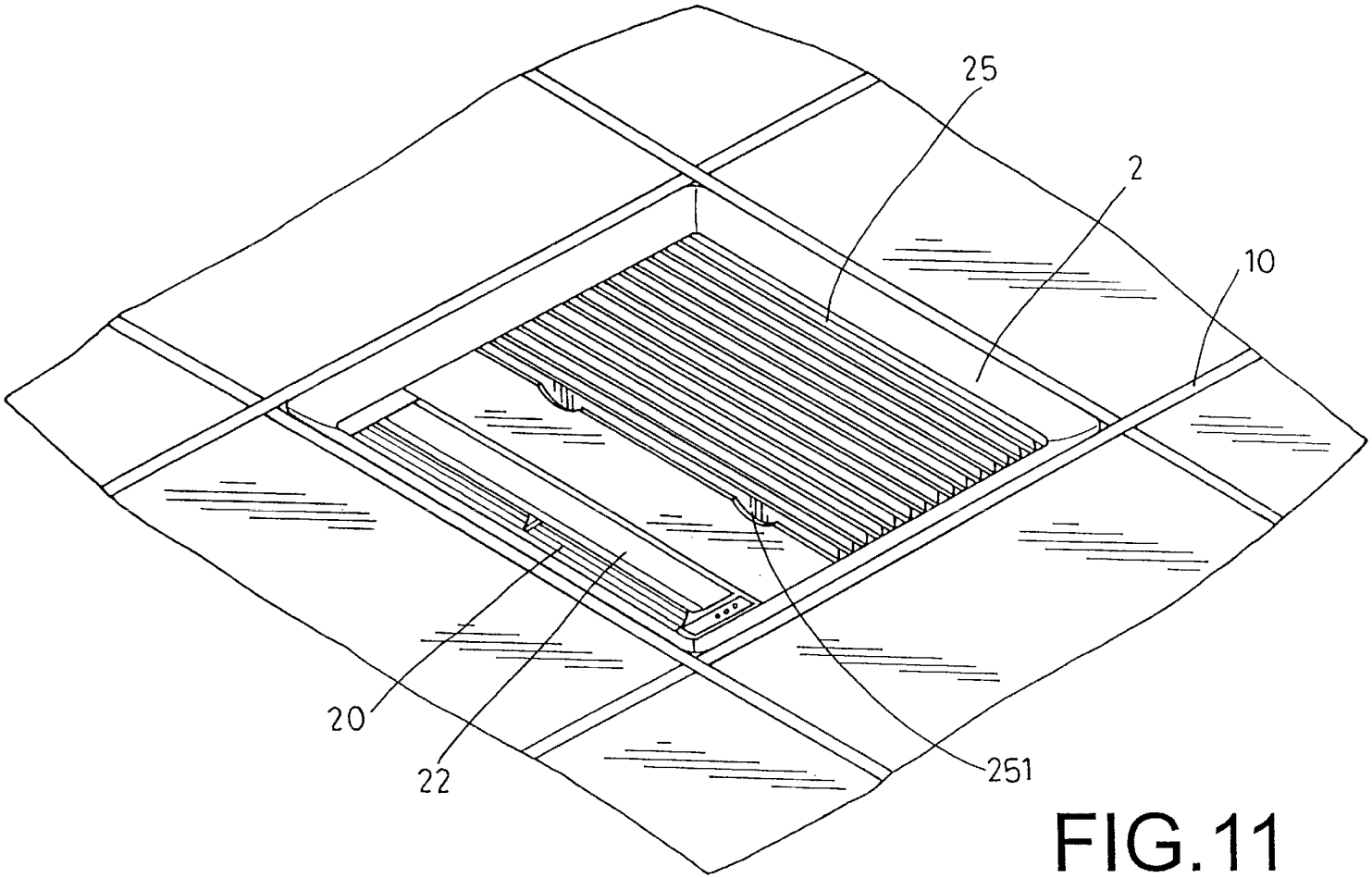
FIG. 11 is a schematic view of the faceplate of a blower for an air conditioner in the present invention, showing the faceplate is installed on a ceiling formed with steel frames.
Figure 12:
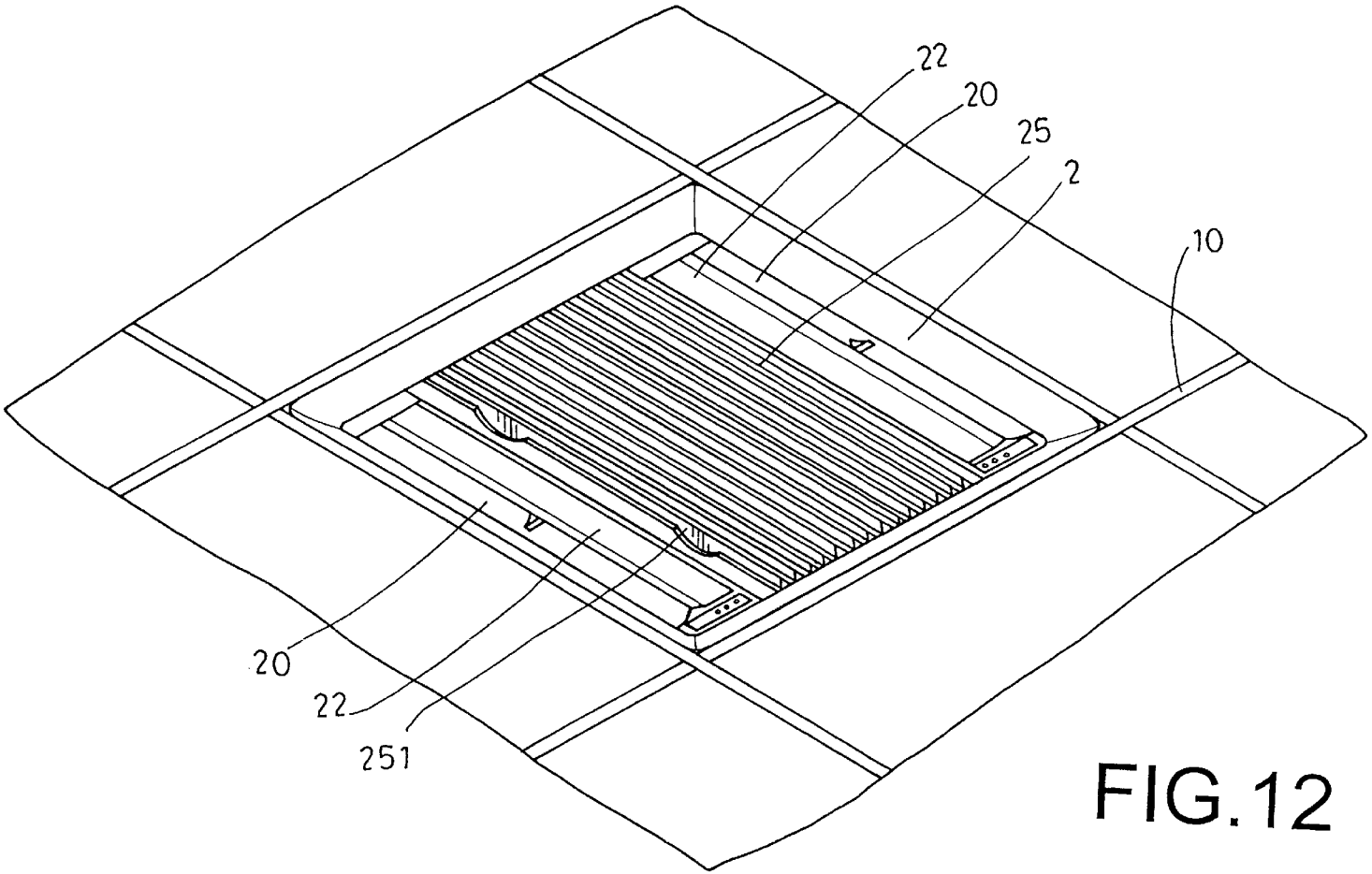
FIG. 12 is a schematic view of the faceplate of a blower for an air conditioner in the present invention, showing one construction of the faceplate provided with at least one wind outlet; and, FIG. 13 is a schematic view of the faceplate of a blower for an air conditioner in the present invention, showing another construction of the faceplate provided with at least one wind outlet.
Figure 13:
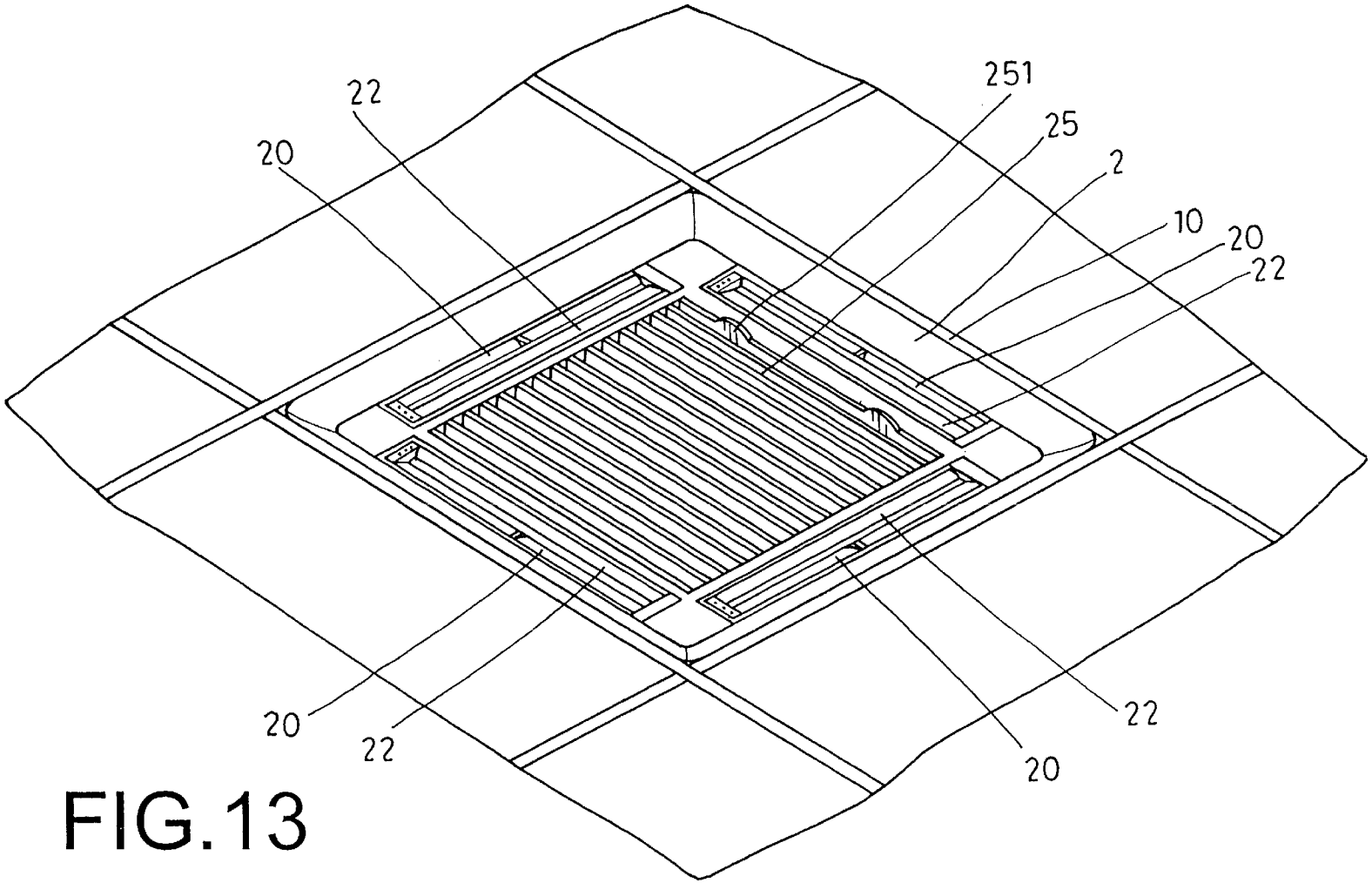

Moreover, the faceplate 2 is designed to be juxtaposed with at least one wind outlet 20 so as to construct a multi-blowing faceplate, as shown in FIGS. 11 to 13.

While the preferred embodiments of the invention have been described above, it will be recognized and understood that various modifications may be made therein and the appended claims are intended to cover all such modifications that may fall within the spirit and scope of the invention.

What is claimed is:

1. A faceplate of a blower for an air conditioner comprising:

a faceplate juxtaposed with at least one wind outlet and at least one wind inlet, wherein each said wind outlet is disposed with a wind-out windpipe base provided with at least one wind-out hole for being covered with a windpipe to blow air out; and, wherein each said wind inlet is provided with a detachable grille; at least one groove disposed in an inner wall of one side of each said wind inlet is capable of corresponding to at least one hook member disposed in one sidewall of said grille; at least one engagement hole disposed in another side of said wind inlet is capable of corresponding to at least one elastic-retaining member disposed in the other sidewall of said grille; and, whereby said grille is conveniently hooked onto said wind inlet and is capable of being held to said faceplate in a suspended way of allowing one side of said grille to be removed from said faceplate, whereby a combination of said components described above provides said faceplate with functions of wind-blowing and wind-suction.

2. A faceplate of a blower for an air conditioner comprising:

a faceplate juxtaposed with at least one wind outlet and at least one wind inlet, wherein each said wind outlet is disposed with a wind-out windpipe base provided with at least one wind-out hole for being covered with a windpipe to blow air out; each said wind inlet is disposed with a wind-in windpipe base provided with at least one wind-in hole for being engaged with a windpipe to suck air in; and, wherein each said wind inlet is provided with a detachable grille; at least one groove disposed in an inner wall of one side of each said wind inlet is capable of corresponding to at least one hook member disposed in one sidewall of said grille; at least one engagement hole disposed in another side of said wind inlet is capable of corresponding to at least one elastic-retaining member disposed in the other sidewall of said grille; and, whereby a combination of said components described above provides said faceplate with functions of wind-blowing and wind-suction.

3. A faceplate of a blower for an air conditioner comprising:

a faceplate juxtaposed with at least one wind outlet and at least one wind inlet, wherein said faceplate is combined with an integral windpipe base assembly provided with at least one wind-out hole and at least one wind-in hole for being connected with windpipes to blow air out and suck air in; and wherein each said wind inlet is provided with a detachable grille; at least one groove disposed in an inner wall of one side of each said wind inlet is capable of corresponding to at least one hook member disposed in one sidewall of said grille; at least one engagement hole disposed in another side of said wind inlet is capable of corresponding to at least one elastic-retaining member disposed in the other sidewall of said grille; and.

4. The faceplate of a blower for an air conditioner as claimed in claim 2, wherein an engagement edge is formed in circumference of each said wind-in hole of said wind-in windpipe base for convenience of being engaged with a windpipe.

5. The faceplate of a blower for an air conditioner as claimed in claim 3, wherein an engagement edge is formed in circumference of each said wind-in hole of said integral windpipe base assembly for convenience of being engaged with a windpipe.

* * * * *